US011717034B2

(12) United States Patent
Wanigaratne

(10) Patent No.: US 11,717,034 B2
(45) Date of Patent: Aug. 8, 2023

(54) SOCK HAVING CONTINUOUS STORAGE CHAMBER AND METHOD OF MAKING SAME

(71) Applicant: Jordan Joyce Wanigaratne, San Diego, CA (US)

(72) Inventor: Jordan Joyce Wanigaratne, San Diego, CA (US)

( * ) Notice: Subject to any disclaimer, the term of this patent is extended or adjusted under 35 U.S.C. 154(b) by 0 days.

(21) Appl. No.: 16/946,076

(22) Filed: Jun. 4, 2020

(65) Prior Publication Data

US 2020/0383386 A1 Dec. 10, 2020

Related U.S. Application Data

(60) Provisional application No. 62/921,174, filed on Jun. 4, 2019.

(51) Int. Cl.
*A41B 11/00* (2006.01)

(52) U.S. Cl.
CPC ..... *A41B 11/006* (2013.01)

(58) Field of Classification Search
CPC ..... A41B 11/006; A41B 11/00; A41B 11/003; A41B 11/005; A41B 11/02; A41B 11/04; A41B 11/08; A45F 2005/008; A45F 2003/006; A41D 27/20; A41D 27/201; A41D 27/204; A41D 27/205; A41D 27/207; A41D 13/0012; A41D 17/02; A01K 15/02
USPC ..... 2/239, 247, 248, 250, 251, 252, 242; 119/702, 712; 224/267; 36/2 R
See application file for complete search history.

(56) References Cited

U.S. PATENT DOCUMENTS 338,341 A * 3/1886 Dodge ..... D04B 1/26 66/188
1,117,591 A * 11/1914 Morningstar ..... A41B 11/006 2/239
2,039,197 A * 4/1936 Strieby ..... A41B 11/006 2/239
2,814,807 A * 12/1957 Dollar ..... A41B 11/006 2/239
4,005,494 A 2/1977 Burn
4,038,699 A 8/1977 Burn
4,255,819 A * 3/1981 Klingspor ..... D04B 1/26 66/185
4,445,233 A * 5/1984 Rubin ..... A41B 11/006 2/239

(Continued)

FOREIGN PATENT DOCUMENTS

CN 200976897 Y * 11/2007
CN 108936842 A * 12/2018

(Continued)

*Primary Examiner* — Amy Vanatta
(74) *Attorney, Agent, or Firm* — Gary L. Eastman, Esq.; Eastman IP

(57) ABSTRACT

A Sock Having Continuous Storage Chamber includes a sock body and a chamber material that together form a circumferential storage chamber. The circumferential chamber is formed with an aperture sized to receive a zipper base with a zipper having a zipper pull to open and close the zipper to provide access to the chamber. The chamber material may include a mesh allowing air to pass through the mesh to ventilate the chamber and allow, depending on use, the scent of a dog treat to pass therethrough.

11 Claims, 12 Drawing Sheets

(56) References Cited

U.S. PATENT DOCUMENTS 4,961,235 A * 10/1990 Williger ..... A41B 11/006 2/239
5,027,440 A 7/1991 Morris et al.
5,131,099 A * 7/1992 Zellweger ..... D04B 1/04 66/172 R
5,133,091 A * 7/1992 del Valle Mas ..... A41B 11/006 2/247
5,148,769 A 9/1992 Zelinger
5,157,791 A * 10/1992 Woodson ..... D04B 1/26 2/239
5,499,403 A 3/1996 Harrigan
5,651,142 A * 7/1997 del Valle Mas ..... A41B 11/006 2/239
5,664,263 A * 9/1997 Reynolds ..... A41B 11/006 2/239
6,199,216 B1 3/2001 Weatherspoon
6,688,258 B1 2/2004 Kolesar
7,600,488 B2 10/2009 Mann
2002/0023288 A1* 2/2002 Garneau ..... A41B 11/001 2/239
2004/0237174 A1* 12/2004 Papel ..... A41B 11/006 2/239
2007/0022519 A1* 2/2007 South ..... A41B 11/02 2/239
2009/0000012 A1* 1/2009 Hsieh ..... A41B 11/006 2/240
2012/0030861 A1* 2/2012 Miller ..... A41D 1/08 2/221
2014/0041260 A1* 2/2014 Jewell ..... A43B 3/0078 36/2 R
2015/0096106 A1* 4/2015 Bell ..... A41B 11/006 2/239
2015/0189946 A1* 7/2015 Nigri ..... A41B 11/006 2/239
2018/0084852 A1* 3/2018 Page ..... A41D 27/207
2019/0059455 A1* 2/2019 Vaughn ..... A41B 11/006

FOREIGN PATENT DOCUMENTS

DE 29920446 U1 * 2/2000 ..... A41B 11/006
DE 20210863 U1 * 2/2003 ..... A45F 5/00
WO WO-8401790 A1 * 5/1984

* cited by examiner

SOCK HAVING CONTINUOUS STORAGE CHAMBER AND METHOD OF MAKING SAME

RELATED APPLICATIONS

This application claims the benefit of priority to the U.S. Provisional Patent Application for "Mesh Zipper Pocket On A Sock For Pet Treats And Method Of Making Same," Ser. No. 62/921,174, filed on Jun. 4, 2019, and currently co-pending.

FIELD OF THE INVENTION

The present invention relates in general to a hosiery sock with a unique and novel way to keep a dog near the owner and method of making same. This design can also be applied to hold items such as money, keys and credit cards in addition to holding dog treats. It more particularly relates to a specially constructed sock with functionality and design to keep a dog near the owner that contains at least one mesh zipper type pocket that wraps around the entire ankle.

BACKGROUND OF THE INVENTION

There is no admission that the background art disclosed in this section legally constitutes prior art. There have been many different types and kinds of socks with various types of pockets, devices to hold pet treats and pet toy amusement devices. For example, reference may be made to U.S. Pat. Nos. 4,005,494; 6,199,216 B; 5,027,440; 4,038,699; 5,148,769; 7,600,488 B2; 6,688,258 B1 and 5,499,403.

One of the issues with most dogs on a walk is the problem of keeping the dog within the vicinity and control of the owner. This pertains to environments on a street where it might be dangerous for the dog or in a public place where restraint is required or on a walk in a neighborhood where the dog must be kept from running around. The typical solution used today is some sort of a leash which is carried by the owner and secured to the dog. The problems with this approach is the need of the owner to own a suitable leash, the control of the leash rope could result in awkward collisions with objects and the dog under restraint can actually cause more stress physically for the dog and owner.

Additionally, it is often advantageous to have a pocket or storage device while out and about that does not include pants pockets, jacket pockets, a backpack, handbag, or purse. In such instances, it would be advantageous to have access to a storage compartment that is readily available, does not include any extra clothing or devices, and can be accessed rapidly when needed.

SUMMARY OF THE INVENTION

Thus there is a need for a leash-less restraint system that 1) enables the owner and dog to not be physically attached 2) allows for freedom for the dog but still keeps the dog in the vicinity of the owner and 3) minimizes physical stress for the dog's neck. More specifically this design takes advantage of the following characteristics of dogs to hold the attention of the dog and keep them in the vicinity of the owner: dog's sense of smell is 10,000 to 100,000 times that of humans; and dog's vision is different from humans and colors of yellow and blue have the greatest contrast. By using a treat or other dog friendly consumable or scented device in a specifically constructed zipper pocket on a sock which wraps the entire ankle this will catch the attention of the dog and will be drawn to the owner.

Several embodiments of the present invention are disclosed which provide a sock with the following advantages:

1. The sock with the pocket is near the ground so that the dog can use its senses of smell and sight to locate the "treat" better. This is versus other potential pocket solutions which are located in pants, shirts, jackets, etc.
2. 360 degree pocket around the sock which allows for unencumbered visibility and smell of the treat. Most pockets have a single facing side.
3. The pocket is sealed with a zipper that is heat press bonded to the sock fabric. This allows for the contents in the pocket to remain secure and not fall out.
4. The pocket is a mesh type which allows for optimal diffusion of smell from the pocket. Most pockets are of a solid material.
5. The pocket material is made of spandex or similar stretching material which allows the dog to retrieve the treat by manipulating it with his nose/mouth
6. The color of the pocket is made such that it is high contrast for the vision of the dog.
7. The configuration of the pocket, mesh and treat allows the combination to be playful and catch attention of the dog.

In one embodiment of the invention, the sock has a mesh pocket of a cylindrical nature wrapping the entire ankle. The pocket is formed through 2 layers of material which wrap around the top part of the sock. The inner material physically touches the leg and the outer material forms the pocket. The outer material pocket mesh is made up of a plurality of gaps of different shapes and constructed of a spandex material with contrasting color to the foundation sock color. The outer material of the pocket has a slit for the pocket opening with a zipper bonded to the sock fabric in order to close the pocket.

Further aspects of the invention will become apparent from consideration of the drawings and the ensuing description of the preferred embodiments of the invention. A person skilled in the art will realize that the other embodiments of the invention are possible and the details of the invention can be modified in a number of respects, all without departing from the inventive concept. Thus, the following drawings and description are to be regarded as illustrative in nature and not restrictive. Further, words such as "about", "approximately", or other words as used herein shall be defined to mean a tolerance of plus or minus 20 percent.

Several features of the present invention are disclosed. For example, a preferred embodiment includes a sock comprising one 360 degree cylindrical mesh pocket made with at least one gap in the mesh and at least one flexible type material sealed with a zipper. In that embodiment, the number of gaps in the mesh can be one or a plurality of gaps and the gap can be made of different patterns from square, diamond, triangle to hexagonal. It may also include dimensional size of the gaps can be of 0.25 mm to 5 mm in length on any given side, and the mesh pocket material may be made up of a reinforced spandex material which is allowed to stretch parallel to the plane of pocket in the direction of the pattern of the gap. The pocket opening is sealed with a zipper which is bonded to the sock fabric with a specific combination of TPU based heat press tape, temperature, heating time and fabric stretch.

A variety of other embodiments are disclosed, and include a sock having a 360 degree cylindrical mesh pocket made with at least one gap in the mesh and at least one flexible type material and the foundation sock material is of different color to the mesh pocket color. In one embodiment, the color of the foundation sock material is yellow and the mesh pocket color is blue.

While particular embodiments of the present invention have been disclosed, it is to be understood that various different modifications are possible and are contemplated within the true spirit and scope of the appended claims. There is no intention, therefore, of limitations to the exact abstract or disclosure herein presented.

BRIEF DESCRIPTION OF THE DRAWING

It will be readily understood that the components of the embodiments as generally described and illustrated in the drawings herein, could be arranged and designed in a wide variety of different configurations. Thus, the following more detailed description of the embodiments of the system, components and method of the present invention, as represented in the drawings, is not intended to limit the scope of the invention, as claimed, but is merely representative of the embodiments of the invention.

The novel features of this invention, as well as the invention itself, both as to its structure and its operation, will be best understood from the accompanying drawings, taken in conjunction with the accompanying description, in which similar reference characters refer to similar parts, and in which.

DETAILED DESCRIPTION

Figure 1:
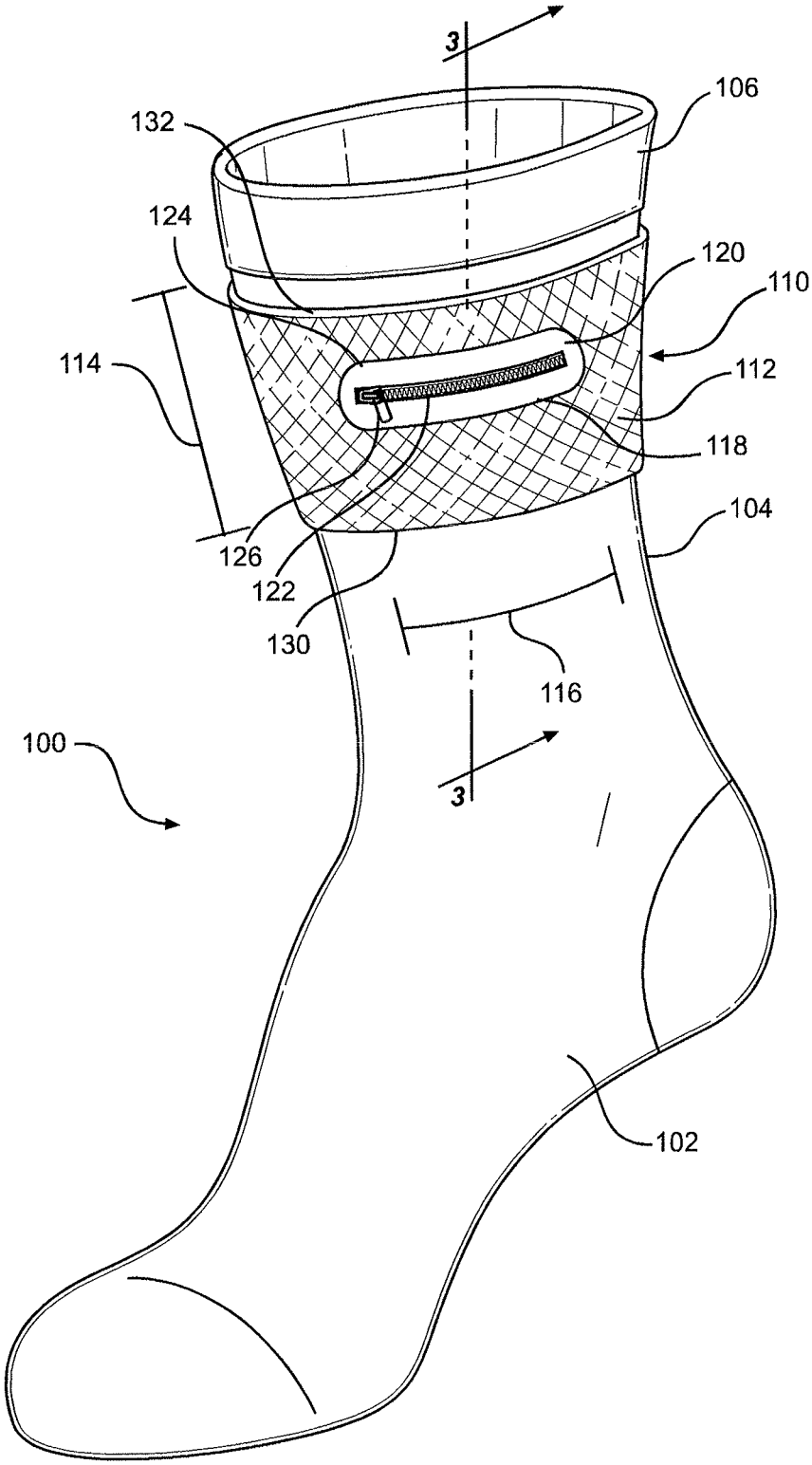
FIG. 1 is a perspective view of the Sock Having Continuous Storage Chamber of the present invention showing a having a circumferential storage chamber made of mesh that is equipped with a zipper allowing access to the storage chamber and positioned near the uppermost portion of the sock above the wearer's ankle.

Referring initially to FIG. 1 a perspective view of the Sock Having Continuous Storage Chamber of the present invention is generally designated 100 and includes a sock body 102 having an ankle portion 104 and an upper edge 106. A circumferential chamber 110 is formed with a chamber material 112 which in this embodiment, includes a mesh allowing air to pass through the mesh to ventilate the chamber and allow, depending on use, the scent of a dog treat to pass therethrough. The circumferential chamber 110 may have a height 114, and be equipped with an aperture 118 with a width 116 and sized to receive a zipper base 120 formed with a zipper 122 having a zipper pull 126 to open and close the zipper 122 to provide access to the chamber 110.

In a preferred embodiment of the Sock Having Continuous Storage Chamber 100, the circumferential storage chamber material 112 may be attached at seams 130 and 132 using a variety of attachment methods known in the art. For instance, the material 112 may be stitched to the sock with threads 134 (shown in FIG. 3), or it may be fixed to the sock body 102 using an adhesive, such as Thermoplastic polyurethane (TPU). TPU is any of a class of polyurethane plastics with many properties, including elasticity, transparency, and resistance to oil, grease and abrasion. Technically, they are thermoplastic elastomers consisting of linear segmented block copolymers composed of hard and soft segments.

Figure 2:
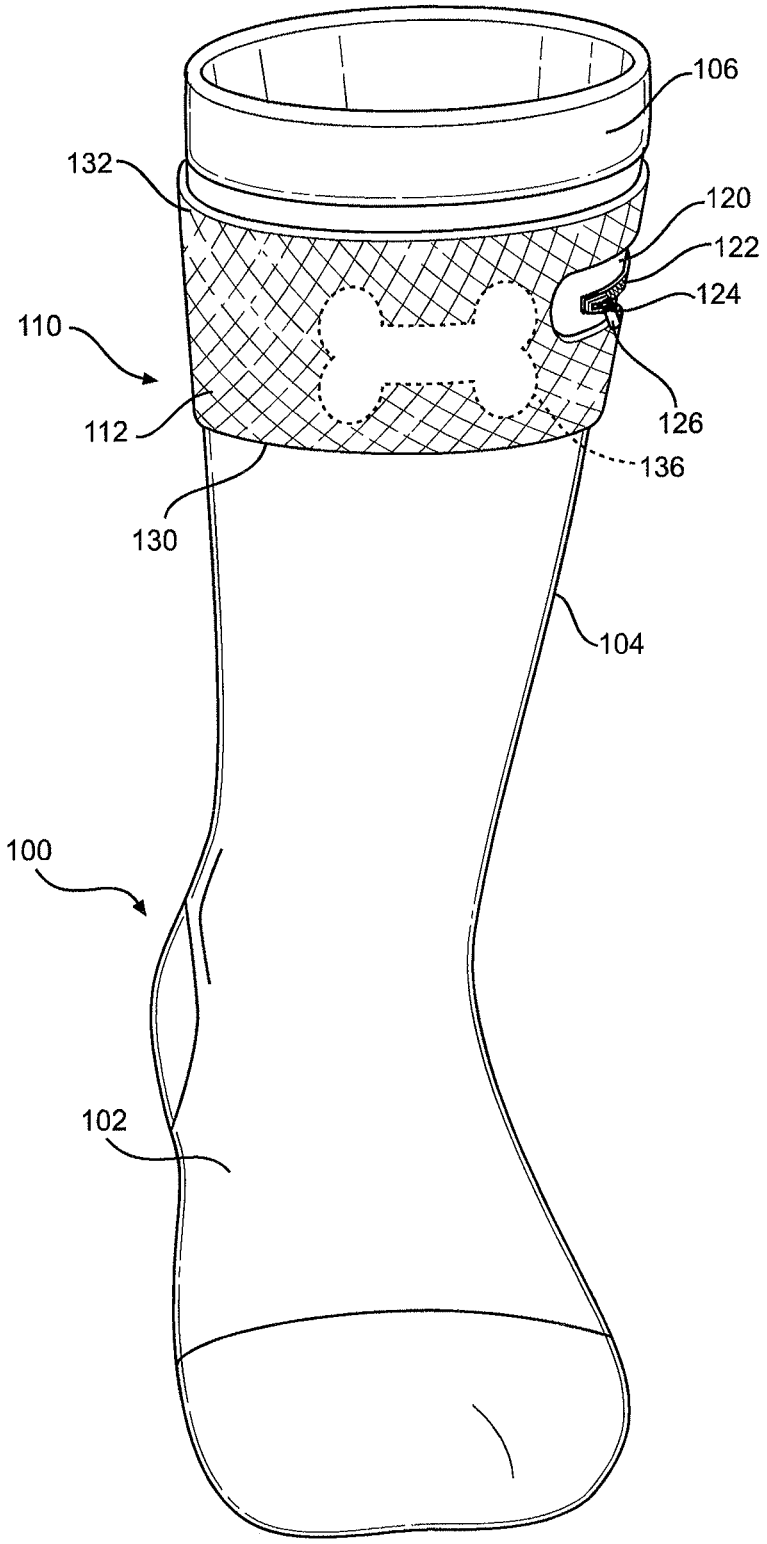
FIG. 2 is a front view of the Sock Having Continuous Storage Chamber shown in FIG. 1 and depicting a dog treat stored within the storage chamber and visible and smellable by a dog and further showing the circumferential nature of the storage chamber.

FIG. 2 is a front view of the Sock Having Continuous Storage Chamber shown in FIG. 1 and depicting a dog treat 136 (shown in dashed lines) stored within the storage chamber and visible and smellable by a dog and further showing the circumferential nature of the storage chamber 110

FIGS. 3 through 8 are cross-sectional views of various preferred embodiments of the Sock Having Continuous Storage Chamber of the present invention showing a variety of chamber configurations and attachment methods for the chamber to the sock.

Figure 3:
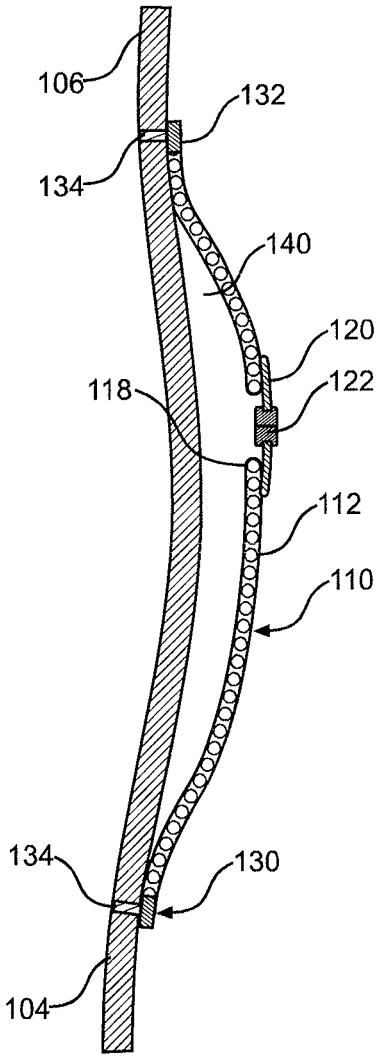
FIGS. 3 through 8 are cross-sectional views of various preferred embodiments of the Sock Having Continuous Storage Chamber of the present invention showing a variety of chamber configurations and attachment methods for the chamber to the sock.

FIG. 3 is the cross-section of Sock Having Continuous Storage Chamber of the present invention 100 as shown in FIG. 1 and taken alone line 3-3. This cross-sectional view shows the placement of the chamber material 112 over sock body 104 and fixed in place using threads 134. Also from this view, the attachment of the zipper base 120 to the chamber panel 112 using the TPU adhesive is shown. Chamber 140 is created by the attachment of the chamber material 112 to the sock 104, and made accessible using zipper 122 positioned adjacent aperture 118.

Figure 4:
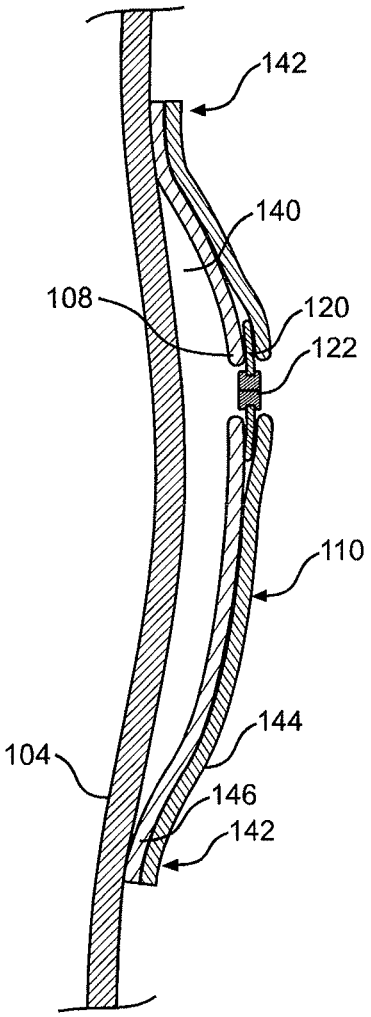

FIG. 4 is a cross-sectional view of an alternative embodiment of the Sock Having Continuous Storage Chamber of the present invention with the chamber material being formed from two material panels 144 and 146 which together and in combination with sock 104 form chamber 140. Material panels 144 and 146 may, in a preferred embodiment, be attached to sock 104 using a heat fusion using TPU adhesives applied in areas 142.

Figure 5:
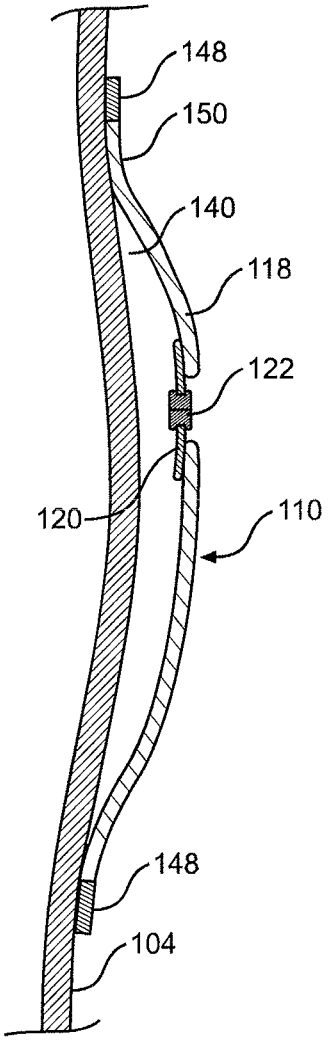

FIG. 5 is a cross-sectional view of an alternative embodiment of the Sock Having Continuous Storage Chamber of the present invention 100 showing chamber 110 formed with a single material panel 150 secured to sock 104 using trim strips 148 which may be attached to sock 104 using any method known in the art including but not limited to stitching and TPU adhesives.

Figure 6:
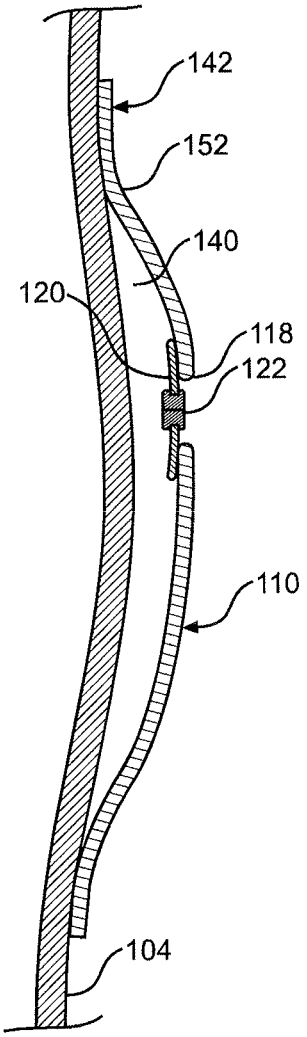

FIG. 6 is a cross-sectional view of an alternative embodiment of the Sock Having Continuous Storage Chamber of the present invention 100 including a single material panel 152 attached at locations 142 to sock 104 using a TPU adhesive.

Figure 7:
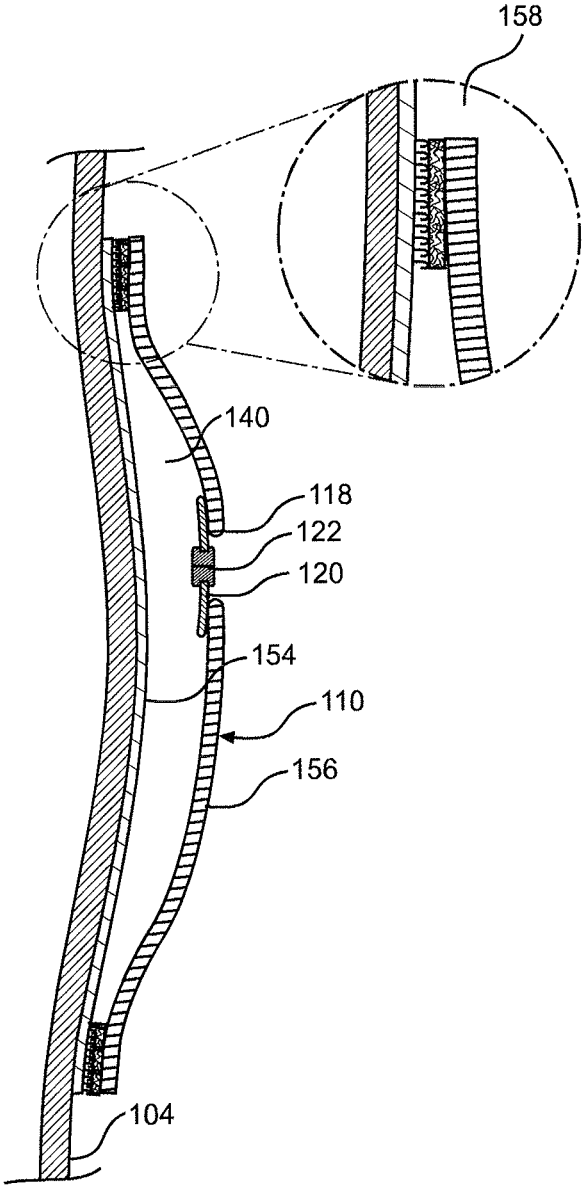

FIG. 7 is a cross-sectional view of an alternative embodiment of the Sock Having Continuous Storage Chamber of the present invention 100 having chamber 110 formed on the exterior surface of sock 104 by attachment of a inner panel 154 and an outer panel 156 which are attached to sock 104 at locations 142 using a TPU adhesive thereby forming a chamber 110 with a storage area 140 that can be accessed using zipper 122. Zipper panel 120 is attached to the inside of material panel 156 using TPU adhesives. Other fastening methods known in the art may be used without departing from the spirit of the present invention, such as hook-and-loop fasteners 158.

Figure 8:
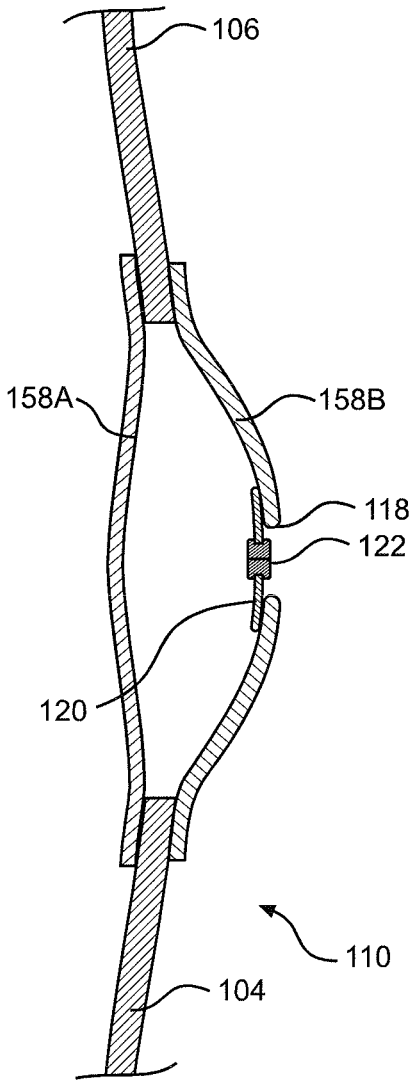

FIG. 8 is a cross-sectional view of an alternative embodiment of the Sock Having Continuous Storage Chamber of the present invention 100 where sock 102 is sectioned into two portions, a lower portion 104 and an upper portion 106. Extending between lower portion 104 and upper portion 106 are inner and outer material panels 158A and 1588, respectively. The panels 158A and 1588 are attached to lower portion 104 and upper portion 106 using a TPU adhesive, and thus form the chamber 110 therebetween. The chamber 110 is accessible using zipper 122 on zipper base 120 which is secured to across aperture 118 of material panel 1588.

Figure 9:
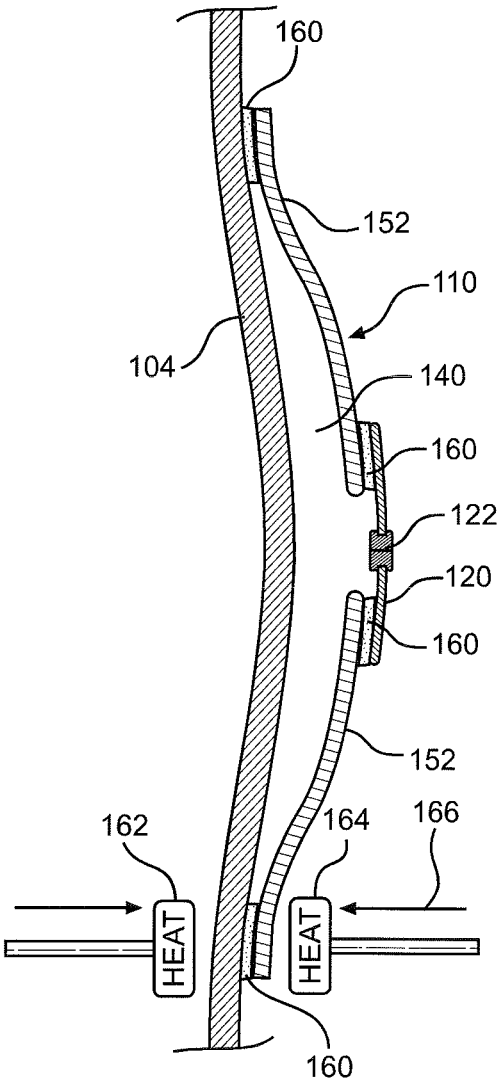
FIG. 9 is a cross-sectional view of the Sock Having Continuous Storage Chamber of the present invention showing an exemplary manufacturing process including the application of a press and heat to the sock and chamber panel with the aid of a TPU adhesive to assemble the present invention.

FIG. 9 is a cross-sectional view of the Sock Having Continuous Storage Chamber of the present invention showing an exemplary manufacturing process including the application of a press and heat to the sock and chamber panel with the aid of a TPU adhesive to assemble the present invention. Material panel 152 is positioned adjacent sock 104 with a TPU material 160 positioned where the material panel 152 and the sock 104 are to be joined. Once positioned, the press heads 162 and 164 are urged in direction 166 to apply pressure to the material panel 152 and sock 104 to capture the TPU. Once captured and pressed together, heat is applied to press heads 162 and 164 to heat the TPU which adheres to both the material panel 152 and sock 104 to secure them together. This process is repeated in several locations of the Sock Having Continuous Storage Chamber of the present invention, including for instance, where the zipper base 120 attached to material panel 152.

FIGS. 10 through 15 are side views of a variety of configurations of the Sock Having Continuous Storage Chamber of the present invention including a number of chamber wall configurations with differing zipper positions, a number of chamber positions, and several materials used to form the chamber integral to the sock.

Figure 10:
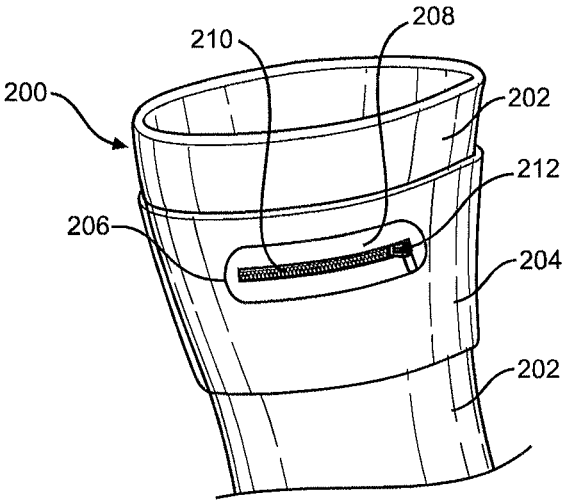
FIGS. 10 through 15 are side views of a variety of configurations of the Sock Having Continuous Storage Chamber of the present invention including a number of chamber wall configurations with differing zipper positions, a number of chamber positions, and several materials used to form the chamber integral to the sock.

FIG. 10 shows an alternative embodiment of the Sock Having Continuous Storage Chamber of the present invention 200 where a storage chamber is made external to sock 202 and formed by fastening the panel 204 to sock 202 and providing an aperture 206 with a zipper base 208 and associated zipper 210 having a zipper pull 212 to provide access to the storage chamber therein.

Figure 11:
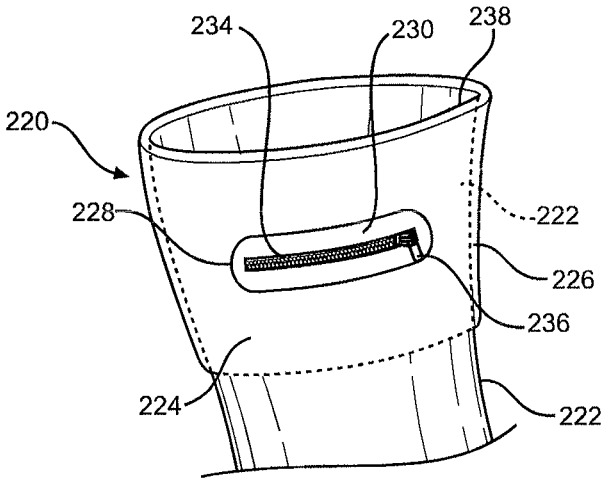

FIG. 11 shows an alternative embodiment of the Sock Having Continuous Storage Chamber of the present invention 220 in which a storage chamber is formed by the placement of a circumferential internal panel 222 inside the upper portion of the sock 224. The circumferential panel 222 forms a pocket with upper portion of the sock 224. Access to the chamber is provided by creating an aperture 228 in sock 224 and providing a zipper base 230 with a zipper 234 and zipper pull 236.

Figure 12:
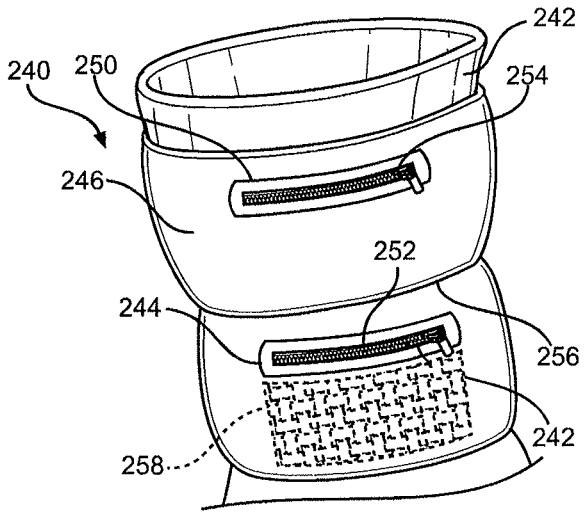

FIG. 12 shows an alternative embodiment of the Sock Having Continuous Storage Chamber of the present invention 240 and includes a sock 242 having a pair of pockets 244 and 246. Each pocket 244 and 246 are formed with apertures 248 and 250, and having zippers 252 and 254, respectively. Pockets 234 and 246 are separated by a seam 256 formed to establish two separate pockets. It is to be appreciated that pockets 244 and 246 may be formed with material panels that are the same, or different. For instance, pocket 244 may be formed with the mesh depicted in FIGS. 1 and 2, or may include a solid panel, such as those depicted elsewhere in this disclosure. Also, while it has been disclosed that panels may be mesh or solid, it is also to be appreciated that a single pocket may be made using a panel that includes both a mesh portion and a solid portion. A mesh portion of panel 244 is shown in dashed lines of FIG. 12.

Figure 13:
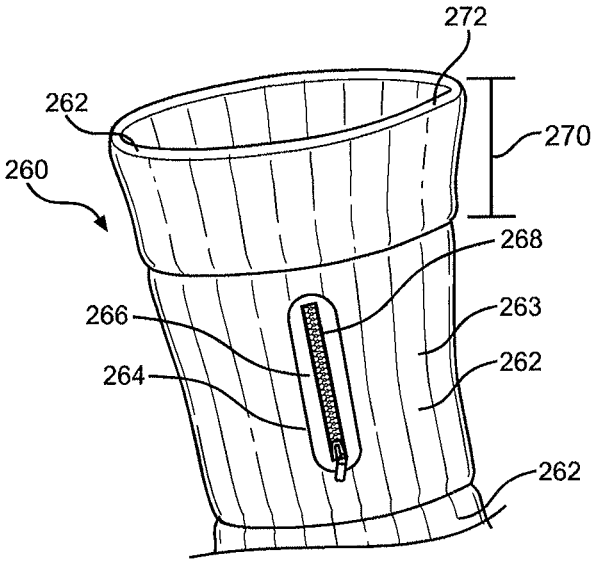

FIG. 13 shows an alternative embodiment of the Sock Having Continuous Storage Chamber of the present invention 260 in which sock 262 is formed to have a pocket 263 a distance 270 down from the upper edge 272 of sock 262. Sock 262 is formed with an aperture 264 in which a zipper base 266 and zipper 268 are mounted to form a pocket therein. The zipper 268 in this embodiment is vertical, and thus it is to be appreciated that the zippers disclosed herein may be in any position that can give access to the chamber or pocket formed adjacent the sock.

Figure 14:
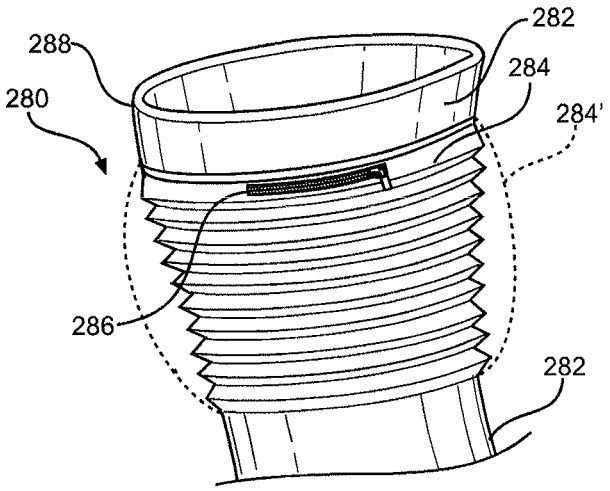

FIG. 14 shows an alternative embodiment of the Sock Having Continuous Storage Chamber of the present invention 280 having a sock 282 with a circumferential panel 284 and having a zipper 286 to define a pocket therein. As shown by dashed lines 284', the external circumferential panel 284 may be formed to expand significantly such as by using an expandable or stretchable material, an according-folded material, or another material that provides sufficient strength to maintain the items placed with the pocket adjacent the sock 282 and wearer's leg.

Figure 15:
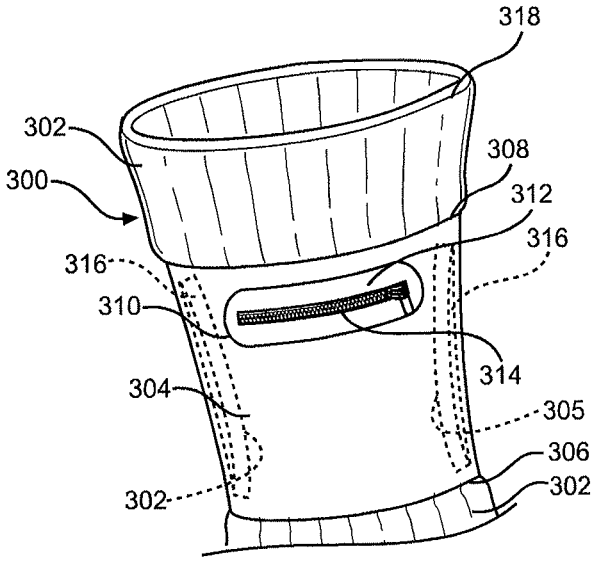

FIG. 15 shows an alternative embodiment of the Sock Having Continuous Storage Chamber of the present invention 300 which shows a sock 302 having a pocket formed by the placement of an exterior panel 304 and an interior panel 305 which are together attached to sock 302 at seams 306 and 308 to form a chamber 316. An aperture 310 is formed on external panel 304 and equipped with a zipper base 312 and zipper 314 to provide access to chamber 316. The placement of the pocket a distance from upper edge 318 of sock 302 is consistent with a preferred embodiment; however, chamber 316 may be positioned elsewhere on sock 302 without departing from the present invention.

Figure 16:
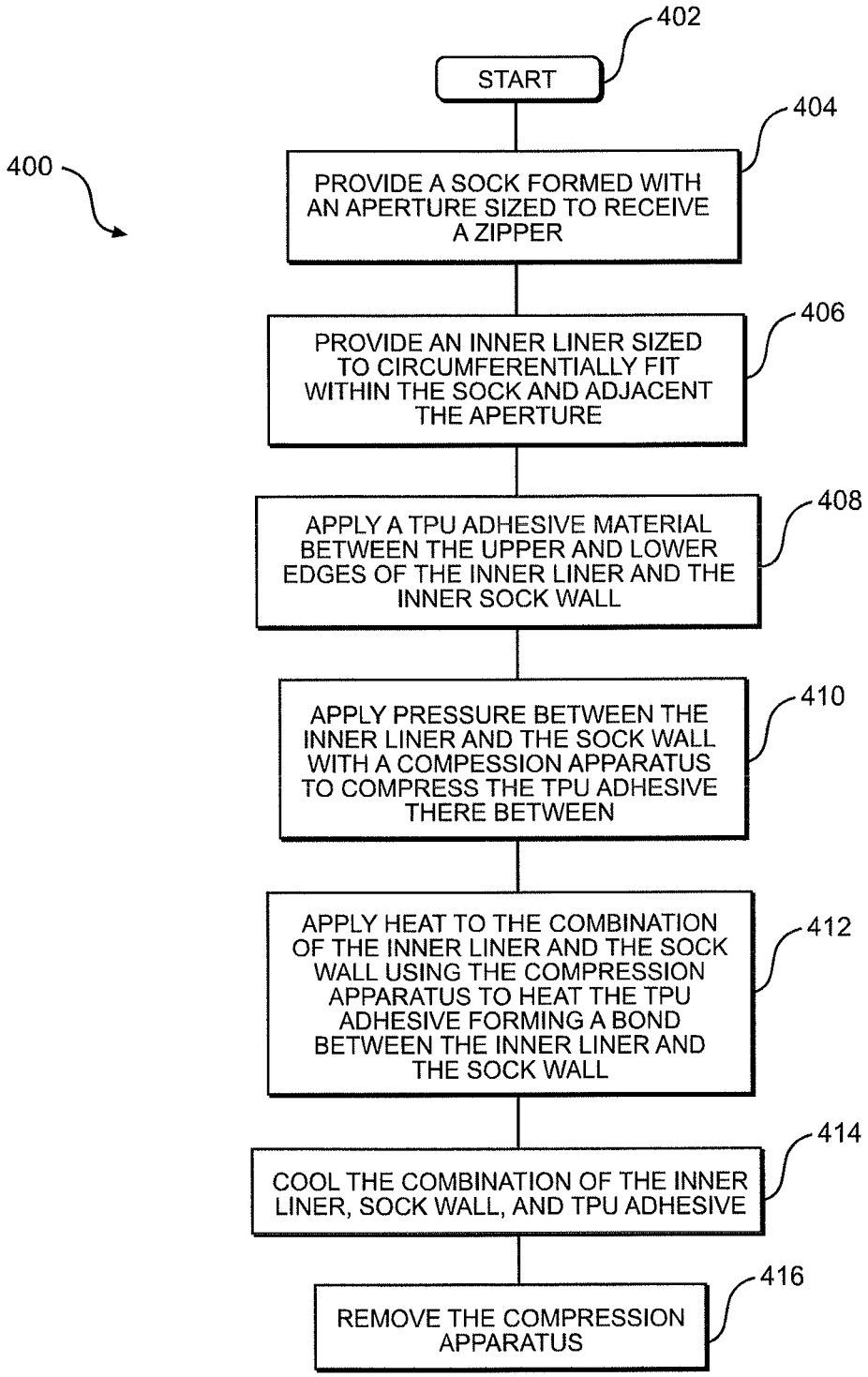
FIG. 16 is a method diagram showing an exemplary method of manufacturing an embodiment of the Sock Having Continuous Storage Chamber of the present invention.

FIG. 16 is a method diagram 400 showing an exemplary method of manufacturing an embodiment of the Sock Having Continuous Storage Chamber of the present invention. Method 400 begins in step 402 and a sock formed with an aperture sized to receive a zipper is provided in step 404. An inner liner sized to circumferentially fit with the sock and adjacent the aperture is provided in step 406, and a TPU adhesive is positioned between the upper and lower edges of the inner liner and the sock wall in step 410.

Once the TPU is positioned between the edges of the inner liner and the sock, heat is applied in combination with a compression apparatus to apply both heat and pressure to the TPU and create a strong and durable seal between the inner liner and the sock. Once pressed and heated, the combination is allowed to cool in step 414 and the compression apparatus is removed in step 416. It is to be appreciated that this process can be repeated multiple times in the manufacturing of a Sock Having Continuous Storage Chamber of the present invention.

Figure 17:
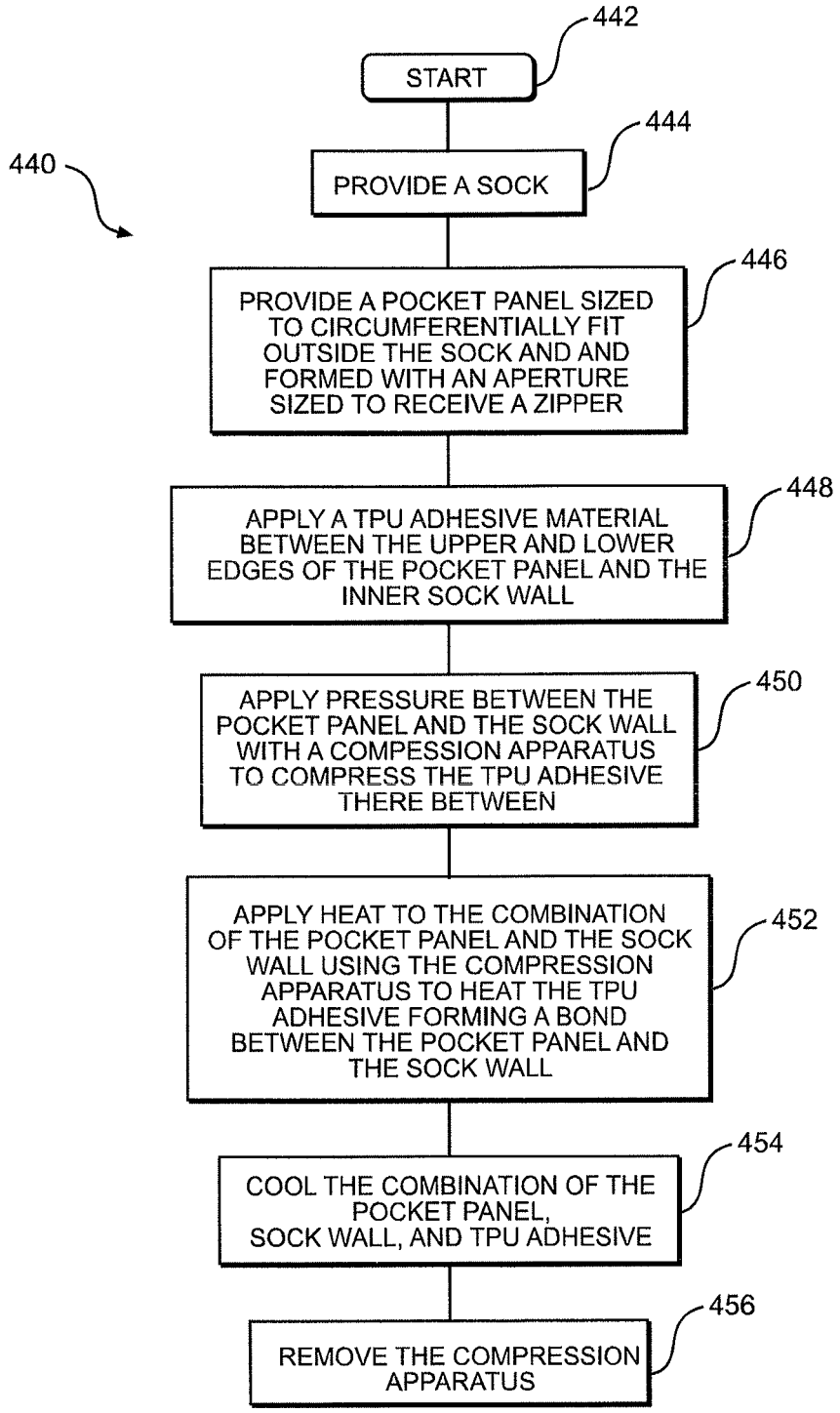
FIG. 17 is a method diagram showing an alternative method of manufacturing an embodiment of the Sock Having Continuous Storage Chamber of the present invention.

FIG. 17 is an alternative method diagram 440 showing an alternative method of manufacturing an embodiment of the Sock Having Continuous Storage Chamber of the present invention. Method 440 begins in step 442 and a sock is provided in step 444. A pocket panel sized to circumferentially fit the outside of the sock is provided in step 446 and has an aperture sized to receive a zipper. A TPU adhesive is applied between the upper and lower edges of the pocket panel and the sock in step 448, and compression apparatus is used to apply pressure to the sock and the pocket panel adjacent the TPU to capture the TPU firmly therebetween in step 450. Heat is applied to the compression apparatus combination of the sock, pocket panel, and TPU in step 452 to create a strong and durable seal between the pocket panel and the sock. Once pressed and heated, the combination is allowed to cool in step 454 and the compression apparatus is removed in step 456.

Figure 18:
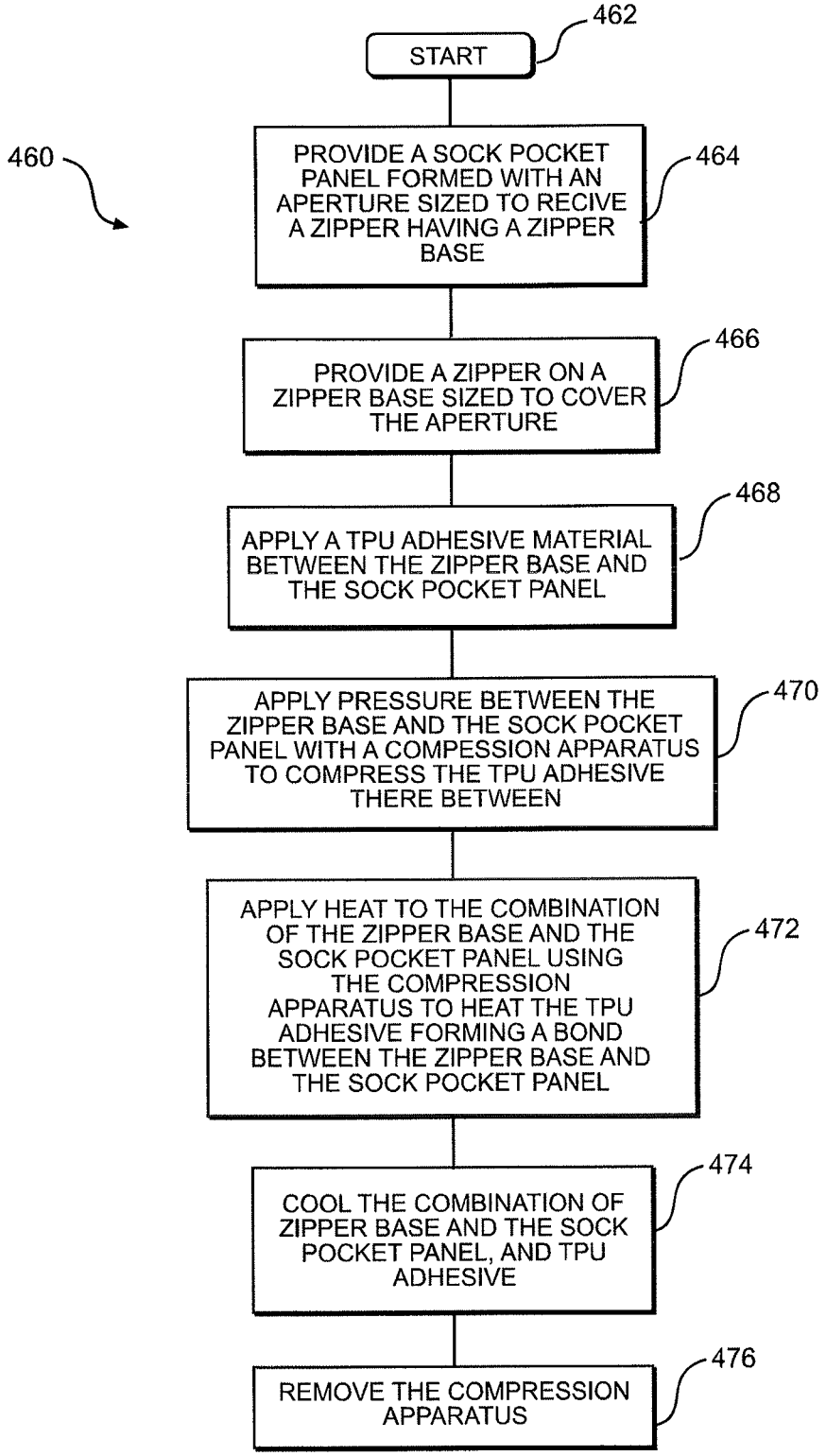
FIG. 18 is a method diagram showing another alternative method of manufacturing an embodiment of the Sock Having Continuous Storage Chamber of the present invention.

FIG. 18 is another method diagram 460 showing another alternative method of manufacturing an embodiment of the Sock Having Continuous Storage Chamber of the present invention. Method 460 begins in step 462 and a sock pocket panel formed with an aperture sized to receive a zipper having a zipper base is provided in step 464. A zipper on a zipper base sized to cover the aperture is provided in step 466, and a TPU adhesive is applied between the zipper base and the sock pocket panel in step 468. A compression apparatus is used to apply pressure between the zipper base and the sock pocket panel to compress the TPU adhesive therebetween in seep 470. Once compressed, heat is applied in step 472 to the combination of the zipper base and the sock pocket panel to heat the TPU which forms a bond between the zipper base and the sock pocket panel. Once heated, the combination is allowed to cool in step 474, and the compression apparatus is removed in step 476.

The use of TPU in combination with the compression apparatus and heat may be used throughout the present invention to establish all connections between materials use in the construction of the Sock Having Continuous Storage Chamber of the present invention. In a preferred embodiment, the TPU is heated to approximately 400 degrees Celsius for a period of approximately 45 seconds to suitably meld the TPU and join the materials used herein. It is to be appreciated, however, that other temperature levels, duration of application, or a combination of the two, may be used without departing from the present invention. It is also to be appreciated that other adhesive methods known in the art may be used without departing from the present invention.

Figure 19:
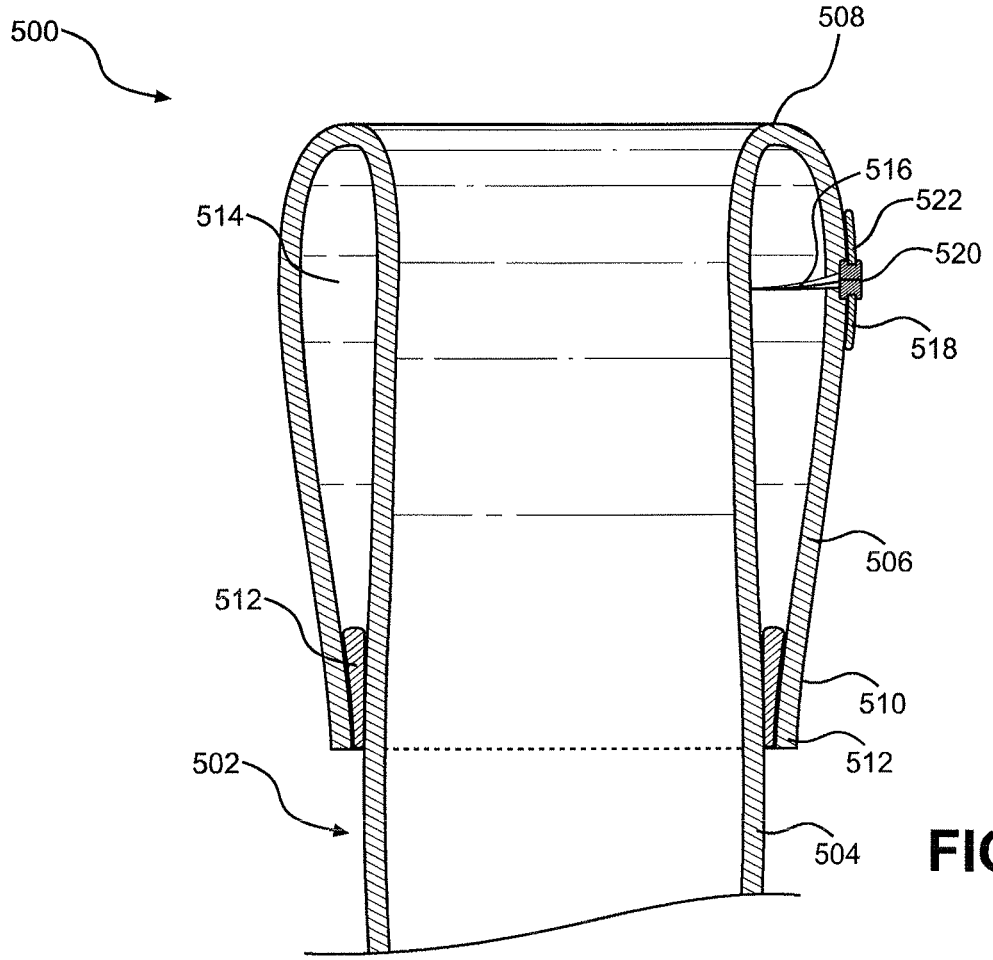
FIG. 19 is a cross-sectional view of the Sock Having Continuous Storage Chamber of the present invention showing the formation of the storage chamber by folding the upper edge of the sock down over itself and securing the upper edge of the sock to the sock side wall to form the chamber, and then providing an aperture over which a zipper base and zipper are attached to form a sealable storage chamber within the folded-down sock.

Referring now to FIG. 19, a cross-sectional view of an alternative embodiment of the Sock Having Continuous Storage Chamber of the present invention 500 is shown. Sock 500 includes a sock panel 502 having an ankle portion 504, and a calf portion 506 which is rolled down at area 508. More specifically, the upper end 510 of sock 502 is folded down against ankle portion 504 and secured in place with TPU 512 using the methods described above in detail. Once upper end 510 is secured against ankle portion 504, a circumferential chamber 514 is formed with the inner panel and outer panel both being made from the sock 502. An aperture 516 is made in the calf portion 506 and equipped with a zipper base 518 having a zipper 520 to provide access to chamber 514.

In addition, or in the alternative, to the use of TPU 512 to attached upper end 510 may be secured using other attachment methods known in the art. For instance, TPU 512 may be augmented with stitching (shown in FIG. 3), hook-and-loop fastener (shown in FIG. 7).

Figure 20:
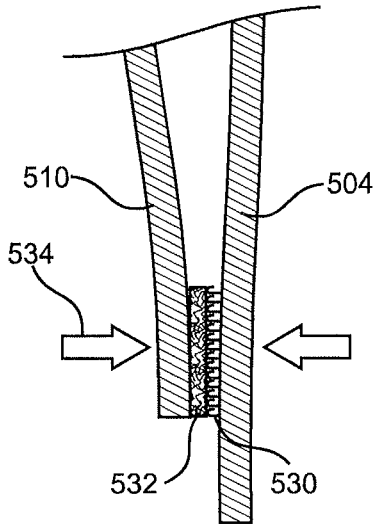
FIG. 20 is a cross-sectional view of the Sock Having Continuous Storage Chamber of the present invention having hook-and-lop fasteners which allows the upper end of the sock to be separated from ankle portion of the sock for normal wear, but also to be pulled down and attached to form a storage chamber.

In an alternative preferred embodiment shown in FIG. 20, in which the TPU 512 of FIG. 19 may be replaced with hook-and-lop fasteners 530 and 532 which will allow the upper end 510 to be separated from ankle portion 504 such that the sock 502 may be worn as a traditional sock with the upper end 510 extending up the wearer's leg. Then, if needed, the upper end 510 may be pulled down over ankle portion 504, and press the hook-and-loop fasteners 530 and 532 in direction 534 to attach the hook-and-loop fasteners to form the chamber 514. Again, access to the storage chamber is through an aperture formed in the sock over which a zipper base and zipper are attached to form a sealable storage chamber within the folded-down sock.

While there have been shown what are presently considered to be preferred embodiments of the present invention, it will be apparent to those skilled in the art that various changes and modifications can be made herein without departing from the scope and spirit of the invention. Accordingly, the invention is not to be limited as except by the appended claims.

I claim:

1. A Sock Having Continuous Storage Chamber, comprising:

a sock body having an ankle portion and an upper edge;

a chamber material attached to the ankle portion of the sock body to form a circumferential chamber, said chamber material formed with an aperture and sized to receive a dog treat, said chamber continuous around the circumference of the sock body, said chamber material comprises an elastic mesh material which provides visibility of contents of the chamber; and a zipper base having a zipper sized to cover said aperture, and movable between a first configuration wherein the zipper is open to provide access to said circumferential chamber, and a second configuration wherein the zipper is closed, wherein said zipper base and said zipper are horizontally oriented on the chamber material.

2. The Sock Having Continuous Storage Chamber of claim 1, wherein the sock body comprises a sock body color, wherein the chamber material comprises a chamber material color, and wherein the chamber material color is a contrasting color to the sock body color.

3. The Sock Having Continuous Storage Chamber of claim 2, wherein the sock body color is yellow and the chamber material color is blue.

4. The Sock Having Continuous Storage Chamber of claim 1, wherein the chamber material comprises spandex.

5. The Sock Having Continuous Storage Chamber of claim 1, wherein the elastic mesh material comprises a reinforced elastic material.

6. The Sock Having Continuous Storage Chamber of claim 1, wherein the elastic material comprises gaps having a length of 0.25 to 5 millimeters.

7. A Sock Having Continuous Storage Chamber, comprising:

a sock body having a foundation sock color;

a 360-degree cylindrical pocket having a pocket color, wherein the pocket color contrasts with the foundation sock color; and a horizontally oriented zipper configured to provide access to the 360-degree cylindrical pocket, wherein the 360-degree cylindrical pocket is attached to the sock body to provide a circumferential storage chamber, and wherein the 360-degree cylindrical pocket comprises an elastic mesh material which provides visibility of contents of the pocket.

8. The Sock Having Continuous Storage Chamber of claim 7, wherein the zipper is attached to the cylindrical pocket.

9. The Sock Having Continuous Storage Chamber of claim 7, wherein the 360-degree cylindrical pocket is attached to the sock body at a position such that the 360-degree cylindrical pocket wraps an ankle of a wearer.

10. The Sock Having Continuous Storage Chamber of claim 7, wherein the elastic mesh material comprises a reinforced elastic material.

11. The Sock Having Continuous Storage Chamber of claim 10, wherein the reinforced elastic material comprises gaps having a length of 0.25 to 5 millimeters.

* * * * *